US005445799A

United States Patent [19]

McCants

[11] Patent Number: 5,445,799

[45] Date of Patent: Aug. 29, 1995

[54] APPARATUS AND METHOD FOR THERMOCRACKING A FLUID

[76] Inventor: Malcolm T. McCants, 2400 Augusta, Suite 260, Houston, Tex. 77057

[21] Appl. No.: 138,114

[22] Filed: Oct. 20, 1993

[51] Int. Cl.[6] ..... F27B 15/14

[52] U.S. Cl. ..... 422/146; 422/145; 422/143; 422/197; 422/198; 165/104.16; 165/174; 208/48 R; 208/48 Q; 208/132

[58] Field of Search ..... 422/145, 146, 139, 143, 422/197, 198; 165/104.16, 174; 208/48 R, 48 Q, 132; 431/7, 170; 432/58; 39/57 A; 110/245; 122/4 D; 261/153

[56] References Cited

U.S. PATENT DOCUMENTS

| | | | |
|---|---|---|---|
| 2,584,391 | 2/1952 | Leffer | 422/143 |
| 3,298,792 | 1/1967 | Di Drusco | 422/143 |
| 34142,542 | 7/1964 | Schwarzenbek et al. | 422/143 |
| 4,150,716 | 4/1979 | Ozaki et al. | 165/1 |
| 4,279,734 | 7/1981 | Gwyn | 208/48 Q |
| 4,426,359 | 1/1984 | Woebcke et al. | 422/145 |
| 4,427,053 | 1/1984 | Klaren | 422/146 |
| 4,639,354 | 1/1987 | Bischoff et al. | 422/143 |
| 4,805,694 | 2/1989 | Ayub | 165/174 |
| 4,922,732 | 5/1990 | Eriksson | 165/174 |
| 4,929,088 | 5/1990 | Smith | 366/337 |
| 5,004,043 | 4/1991 | Mucic et al. | 261/153 |
| 5,139,650 | 8/1992 | Lenglet | 208/132 |

*Primary Examiner*—Robert J. Warden
*Assistant Examiner*—Hien Tran
*Attorney, Agent, or Firm*—Shlesinger, Arkwright, & Garvey

[57] ABSTRACT

A reactor for thermocracking a fluid comprising a heat exchanger having at least one tube for conveying the fluid stream from a respective tube inlet to a tube outlet while contacting the at least one tube with a high temperature medium to effect heat transfer to the fluid stream sufficient to cause thermocracking of the fluid. A quench is provided for discharging a quench liquid so as to be positioned within the thermocracked fluid stream exiting the tube outlet during a cracking operation to immediately lower the temperature of the thermocracked fluid stream sufficient to terminate further thermocracking of the fluid as it emerges from the tube outlet thereby preventing carbon deposition downstream.

19 Claims, 3 Drawing Sheets

APPARATUS AND METHOD FOR THERMOCRACKING A FLUID

FIELD OF THE INVENTION

The present invention generally relates to thermal cracking (or thermocracking) including visbreaking of a hydrocarbon and more particularly towards an apparatus and method for such processes that reduces unwanted carbon deposits during the proceeds.

BACKGROUND OF THE INVENTION

It is well known in the petroleum refining industry to physically treat hydrocarbons thereby chemically changing their molecular structures and converting less valuable compounds into those which are in demand.

One such conversion process is broadly referred to as "cracking", the thermal decomposition of long-chained hydrocarbon molecules into shorter hydrocarbon molecules having lower boiling points. In its broadest sense, thermocracking is typified by processes in which an unrefined hydrocarbon feed is converted by heating within a reactor vessel to a temperature between 800° and 1500° F. and at a pressure of about 200 to 600 pounds per square inch.

There are two general types of thermocracking processes. The first is known as vapor phase while the second is referred to as liquid or mixed phase. In vapor phase thermocracking, the charge stream is completely vaporized during the high temperature cracking process. In liquid or mixed phase cracking, the charge stream is essentially liquid but there does exist some vaporization and generation of non-condensable gases.

Yet another thermocracking process is known as visbreaking, so named because the process reduces the viscosity of heavy crude oil residues thereby making them more suitable for an inclusion into, for example, fuel oils. In visbreaking, a heavy crude oil residue is passed through a thermal reactor or heat exchanger comprising a series of tubes which are subjected to high temperature heat exchange. The heavy crude oil residue is heated above 700° F. to about 900° F. or higher and held at that temperature within the reactor tubes for a period of time sufficient to produce the desired amount of cracking. A gas oil distillant is continually produced and removed as it is generated.

Regardless of the type of thermocracking, all cracking processes deposit or accumulate carbon or coke on the reactor surfaces as well as in apparatus downstream of the reactor. For example, impurities in the charge material such as salts or metal compounds may become deposited on the heat exchanger reactor walls. The deposits gradually increase in thickness and eventually cause a reduction in cracking efficiency of the heat exchanger through the loss of heat transfer. In addition, the excessive carbon deposits slowly insulate the reactor or heat exchanger surfaces as they build up requiring greater and greater quantities of heat to maintain cracking temperatures. This additional heat only further exasperates the problem by producing even more carbon deposits on the reactor surfaces. Eventually, the reactor must be shut down and the deposits are manually removed.

Numerous prior art attempts have been made to prevent the build-up of carbon on the interior walls of a parallel pass reactor or heat exchanger. Many parallel pass reactors or heat exchangers incorporate abrasive, granular media which fluidizes in the process liquid as it travels through the reactor. The granular media impact against the interior tube walls and abrade the carbon as it is formed. The abraded carbon particles are then removed from the reactor during processing without the need for reactor shutdown. For example, U.S. Pat. No. 4,427,053, to Klaren discloses a heat exchanger of the type in which a liquid is passed through a vertical riser tube connected at its upper and lower end to upper and lower tanks respectively and in which a granular mass is present. As the granules are fluidized by the liquid in the reactor, they travel upwardly through the tubes and have a scouring and cleansing effect upon the tube walls.

Although the Klaren device and similar apparatus have addressed the problem of excessive carbon build up, such reactors are not entirely satisfactory when used in connection with a thermocracking or visbreaking operation. Since both thermocracking and visbreaking require heating of the hydrocarbon oil above 700° F., coke and carbon is readily formed as a byproduct. While reactors and heat exchangers which incorporate abrasive particles for circulation do in fact continually clean the interior walls of the riser tubes of deposits, once the visbroken or thermocracked liquids and vapor exit the riser tubes and enter the head portion of the reactor, they continue to crack and deposit carbon within the upper chamber of the reactor and downstream of the reactor. Eventhough the abrasive particles are effective in cleaning the interior of the heat exchanger riser tubes, once outside the narrow tubes the abrasive media is ineffective. Consequently, the thermocracking liquid vapors and gases continue to crack and deposit carbon. Thus, even reactors containing abrasive particles must be shut down for periodic cleaning if the reactors are being used in thermocracking or visbreaking operations. Previously, there has been no effective way to control such carbon deposition within a heat exchanger or reactor employed in such processes.

A need has therefore existed within the art to provide a cracking and visbreaking heat exchanger reactor which minimizes carbon deposition to the reactor as well as downstream of the reactor and thereby ensures long periods of operation without the need for reactor shutdown or periodic cleaning.

OBJECTS AND SUMMARY OF THE INVENTION

The present invention is directed to a reactor for thermocracking a fluid comprising a heat exchanger means having at least one tube for conveying the fluid stream from a respective tube inlet to a tube outlet while contacting the at least one tube with a high temperature medium to effect the transfer to the fluid stream sufficient to cause thermocracking. A quench means is provided for discharging a quench liquid so as to be positioned within the thermocracked fluid stream exiting the fluid tube outlet during a cracking operation to immediately lower the temperature of the thermocracked fluid stream sufficient to terminate further thermocracking of the fluid as it emerges from the tube outlet thereby preventing carbon deposition.

The present invention is additionally directed to a method for thermocracking a fluid comprising the steps of providing a heat exchanger means having at least one tube for conveying a fluid stream from a respective tube inlet to a respective tube outlet. Providing quench means for discharging a quench liquid so as to be positioned within the thermocracked liquid stream exiting the outlet during cracking. Directing a fluid stream into the heat exchanger. Contacting the at least one tube with a high temperature medium to effect heat transfer to the fluid stream sufficient to cause thermocracking and quenching the thermocracked fluid stream exiting the tube outlet with the quench liquid to immediately lower the temperature of the thermocracked fluid stream sufficient to terminate further thermocracking of the fluid as it emerges from the tube outlet thereby preventing carbon deposition.

It is an object of the present invention to lower the temperature of a thermally cracked oil within a heat exchanger or reactor to a temperature below cracking thereby preventing carbon deposition within the reactor and downstream of the reactor.

It is a further object of the present invention to provide a heat exchanger or reactor which is adaptable for visbreaking or thermocracking operations and which will effectively quench a thermocracked hydrocarbon stream of fluid, vapors or intermixed fluid and vapors thereby preventing carbon deposition within the heat exchanger and downstream of the heat exchanger.

It is a further object of the present invention to provide a quench for a heat exchanger or reactor in a visbreaking or thermal cracking operation which uses the crude oil process liquid as the quench.

A still further object of the present invention is to provide a quench in the head portion of a heat exchanger or thermal reactor used in a visbreaking or thermal cracking operation which ensures that the entire thermocracked fluid is effectively quenched below cracking temperatures.

A still further object of the present invention is to increase retention time of the quench and the cracked hydrocarbon by incorporating in the reactor, baffles, dams, multiple inlets, and spray manifolds.

A further object of the present invention is to provide a reactor or heat exchanger for a thermocracking or visbreaking operation which incorporates a mixer at the discharge end of the reactor to ensure that the cracked hydrocarbon is thoroughly intermixed with the quench fluid prior to discharge from the reactor.

Yet a further object of the present invention is to provide a reactor or heat exchanger for a thermocracking or visbreaking operation which can provide a quench that is discharged directly into the thermocracked liquid stream as it exits the heat exchanger tubes to immediately quench the thermocracked hydrocarbon below quenching temperature thereby preventing carbon deposition from occurring.

Still a further object of the present invention is to provide a quench which is selectively preheated to precisely lower the temperature of the cracked effluent below cracking temperatures.

Yet another object of the present invention is to provide a quench manifold which effectively quenches both thermocracked hydrocarbon liquids and vapors to lower the temperature below cracking temperature and prevent carbon deposition.

Yet another object of the present invention is to provide a quench inlet for quenching the thermocracked hydrocarbon within the heat exchanger while also distributing the process fluid with the reactor.

Still a further object of the present invention is to provide a reactor or heat exchanger for visbreaking or thermocracking whereby all the thermocracked liquids and vapors generated are intermixed and quenched to a temperature below thermocracking so that they may only be discharged from the reactor after they are no longer cracking.

Yet a further object of the present invention is to provide a heat exchanger or reactor for visbreaking or thermocracking which will simultaneously handles cracked liquids and vapors produced during the cracking operation.

Still a further object of the present invention is to provide a heat exchanger or reactor which may be used in any type of process or operation whereby the process fluid to be treated is of the type causing fouling of the heat exchanger surfaces.

Still a further object of the present invention is to provide a heat exchanger quench manifold which is unique in construction and which provides enhanced quenching capability for both liquids and vapors.

Yet a further object of the present invention is to provide a heat exchanger or reactor for visbreaking or thermocracking operations having multiple quench inlets and distribution manifolds depending upon the type of thermocracked fluid.

Yet a further object of the present invention is to provide a method for thermocracking or visbreaking fluids whereby the quench fluid temperature is closely monitored and controlled to quench the thermocracked fluid within a reactor to a temperature sufficient to terminate cracking immediately after discharge within the reactor.

The manner in which these as well as other objects of the present invention can be accomplished will be apparent from the following detailed description and drawings.

DETAILED DESCRIPTION OF THE INVENTION

Figure 1:
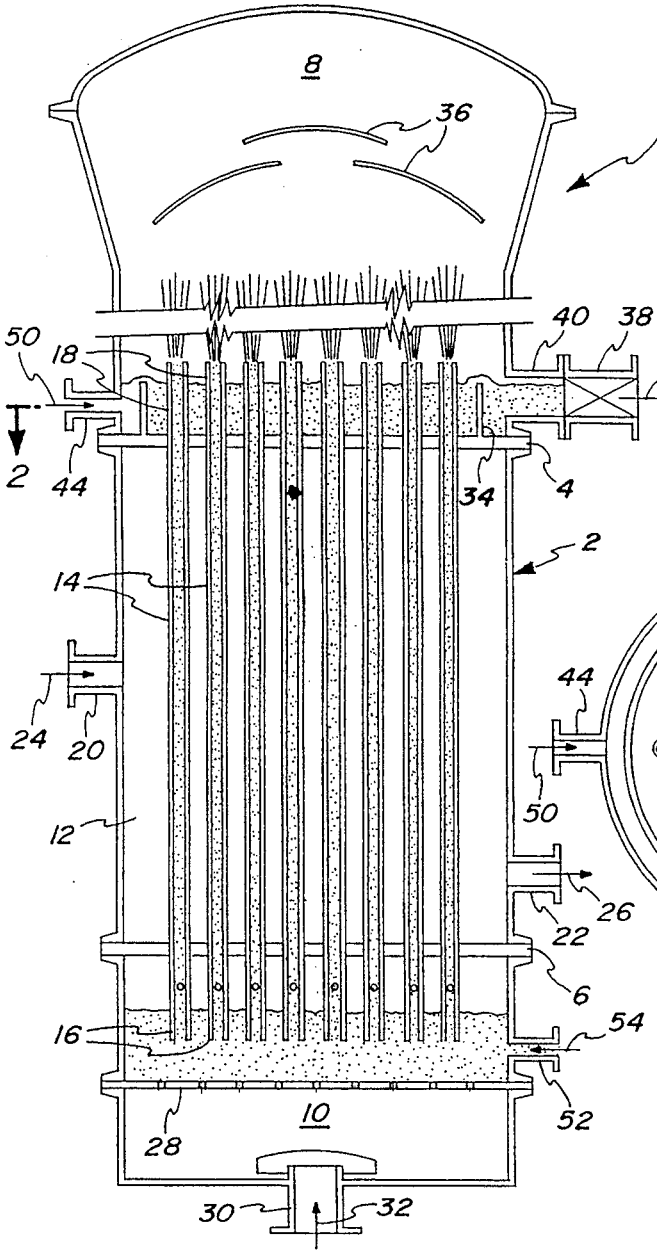
FIG. 1 illustrates the heat exchanger according to the present invention shown in vertical section with a portion of the upper chamber broken away.

As best shown in FIG. 1, a thermal cracking heat exchanger or reactor A according to the present invention is shown comprising an outer casing or shell 2 including upper and lower header plates 4 and 6 dividing the heat exchanger A into an upper chamber 8, lower chamber 10 and heat exchange chamber 12. A plurality or bundle of parallel, vertically extending riser tubes 14 are disposed within the heat exchanger chamber 12 supported by the upper header plate 4 and lower header plate 6. Each of the riser tubes 14 are provided with respective inlets 16 in lower chamber 10 and outlets 18 opening into upper chamber 8. The space surrounding each of the riser tubes 14 within heat exchange chamber 12 contains a heat transfer medium such as steam entering via connection 20 and exiting via connection 22 as indicated by arrows 24 and 26 respectively. The heat exchange medium will contact the exterior of the riser tubes 14 and cause a heat transfer to whatever fluid is traveling within the riser tubes 14. The base of the lower chamber 10 is provided with a horizontal, perforated flow distribution plate 28 with inlet 30 for a process fluid such as crude oil to enter the reactor A. Arrow 32 indicates the direction of inlet flow.

The apparatus includes a granular mass which is fluidized by the process fluid to be thermocracked or visbroken so as to occupy the space within the tubes during operation. The granular mass within the scope of the present invention is well known in the art and may include any of a variety of abrasive particulate media materials available including but not limited to glass, metal beads, shot, small pieces of wire or the like. Small carborundum balls, irregular pieces or other odd shaped media comprising hard material have been used with success. Denstone ® balls (manufactured and marketed by Norton Products Corp.) comprising corundum and silica dioxide is a preferred particulate media. Generally speaking, the selected abrasive media has a preferred size from between about $\frac{1}{8}$ inch to about 1 inch in diameter but not larger than about $\frac{3}{4}$ of the reactor tube diameter.

The horizonal flow distribution plate 28 is perforated to allow the process fluid being treated to enter the inlet 30 and pass through the plate for appropriate heat exchange treatment within heat exchange chamber 12 while at the same time retaining the particulate mass intermixed with it thereby allowing the mass to be conveyed through each of the riser tubes 14.

The upper chamber 8 includes a retaining wall 34 extending upwardly from upper header plate 4 and circumferentially around the various riser tubes 14. Retaining wall 34 functions to increase retention time in the chamber 8 of the thermocracked hydrocarbon liquid to be quenched. A series of baffle plates 36 are disposed a distance above the tube outlets 18 to assist in deflecting vapors back down the lower portion of the upper chamber 8. A static mixer 38 is shown connected to outlet 40 with arrow 42 indicating direction of flow from the heat exchanger A. The static mixer 38 assists in thoroughly intermixing the quench liquid with any thermocracked vapors or liquid prior to discharge from the reactor A. A preferred static mixer according to the present invention is the Kenits ® HEV high efficiency static mixer (manufactured and marketed by Chemineer, Inc., North Andover, Mass.) or equal. The Kenics ® mixer is disclosed in U.S. Pat. No. 4,929,088, the relevant portions of which are incorporated herein by reference.

Figure 2:
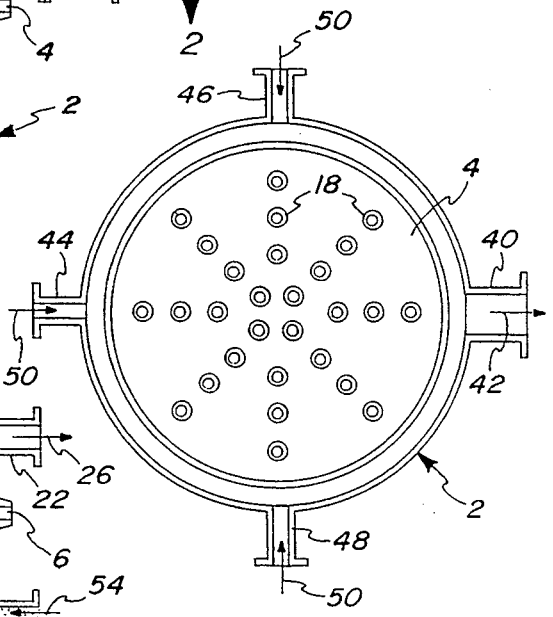
FIG. 2 is a horizontal section taken along lines 2—2 of FIG. 1.

As best shown in FIG. 2, the quench inlets 44, 46 and 48 are disposed about the perimeter of upper chamber 8 so as to allow the quench fluid to enter into the upper chamber 8 in the direction of arrows 50 and adjacent the riser tube outlets 18. The embodiment shown in FIG. 1 and 2 is especially directed to those thermocracking or visbreaking operations wherein the hydrocarbon fluid to be cracked is not substantially vaporized as it passes through the heat exchanger and exits riser tubes 14. Instead, the still cracking hydrocarbon fluid leaving the riser tube 14 will overflow the riser tubes outlets 18 and immediately be contacted by the quench fluid entering the reactor via the quench inlets 44, 46 and 48. As can be appreciated, additional quench inlets may also be provided. The still cracking hydrocarbon is immediately contacted by the quench fluid reducing the temperature of the thermocracked fluid below a temperature of about 700° F. and thus below cracking temperatures. The retaining wall 34 assists in increasing retention time of contact between the quench fluid and the thermocracked effluent fluid within the upper chamber 8 so that the quench can adequately intermix with the thermocracked effluent fluid.

The quenched effluent exits outlet 40 and passes into static mixer 38 further ensuring intermix of the quench with the thermocracked effluent. In a preferred embodiment, the quench also functions as an inlet for the process fluid to be treated. Thus, the quench can comprises a hydrocarbon oil which will eventually be visbroken or thermocracked as it is recycled back into the reactor. Although the quench fluid does not enter the interior of riser tubes 14, the abrasive particulates scour any coke or carbon which may deposit upon the interior of the walls of the riser tubes 14.

Even though the abrasive particulates have very little scouring effect beyond the interior of the riser tubes 14, because the quench oil lowers the temperature of the thermocracked effluent oil below cracking as it exits tube outlets 18, carbon deposition is eliminated. Generally speaking, this non-cracking temperature is below 700° F. since oil will not. deposit coke or carbon below 700° F. but will do so about about 800° F. Thus, the quench fluid may be preheated to a selected temperature so that upon contact with the thermocracked effluent leaving riser tubes 14, it will lower the effluent temperature precisely below the 700° F. range. By controlling the temperature and/or volume of the quench oil, the combined quench fluid and thermocracked stream leaving the outlet 40 is below 700° F. and therefore will no longer crack.

For example, by calculating the heat content for a thermocracked crude oil at 800° F., the heat required to be removed from the thermocracked crude oil to a point below cracking temperature can be determined. Consequently, the quench oil may be selectively heated to a required quench temperature and injected into the heat exchanger at certain rate and volume to effectively reduce the temperature of the thermocracked effluent below about 700° F. Conversely, in the event the hydrocarbon oil is being visbroken at a substantially higher temperature where even greater quantities of vapor are produced and higher liquid temperatures are reached, the quench is preheated to a substantially lower temperature to significantly lower the crackled effluent liquid and vapors to the desired 700° F. non-cracking range.

The quenched and thermocracked effluent containing the particulate media is intermixed in a static mixer 38 prior to discharge from the heat exchanger A as indicated by arrow 42. In a preferred embodiment, the now quenched oil flows into a separator 43 whereby the thermocracked hydrocarbon fraction can be removed or selectively recycled through pump 47 back into heat exchanger A via recycle inlet 52 as indicated by arrow 54. The recycle is closely monitored and controlled to optimize the flow and fluidization of the abrasive particulate mass within the heat exchanger. That system is the subject of my co-pending application entitled METHOD AND APPARATUS FOR THERMOCRACKING OF HYDROCARBONS, U.S. Ser. No. 08/060,071, the pertinent portions of which are incorporated herein by reference.

Figure 3:
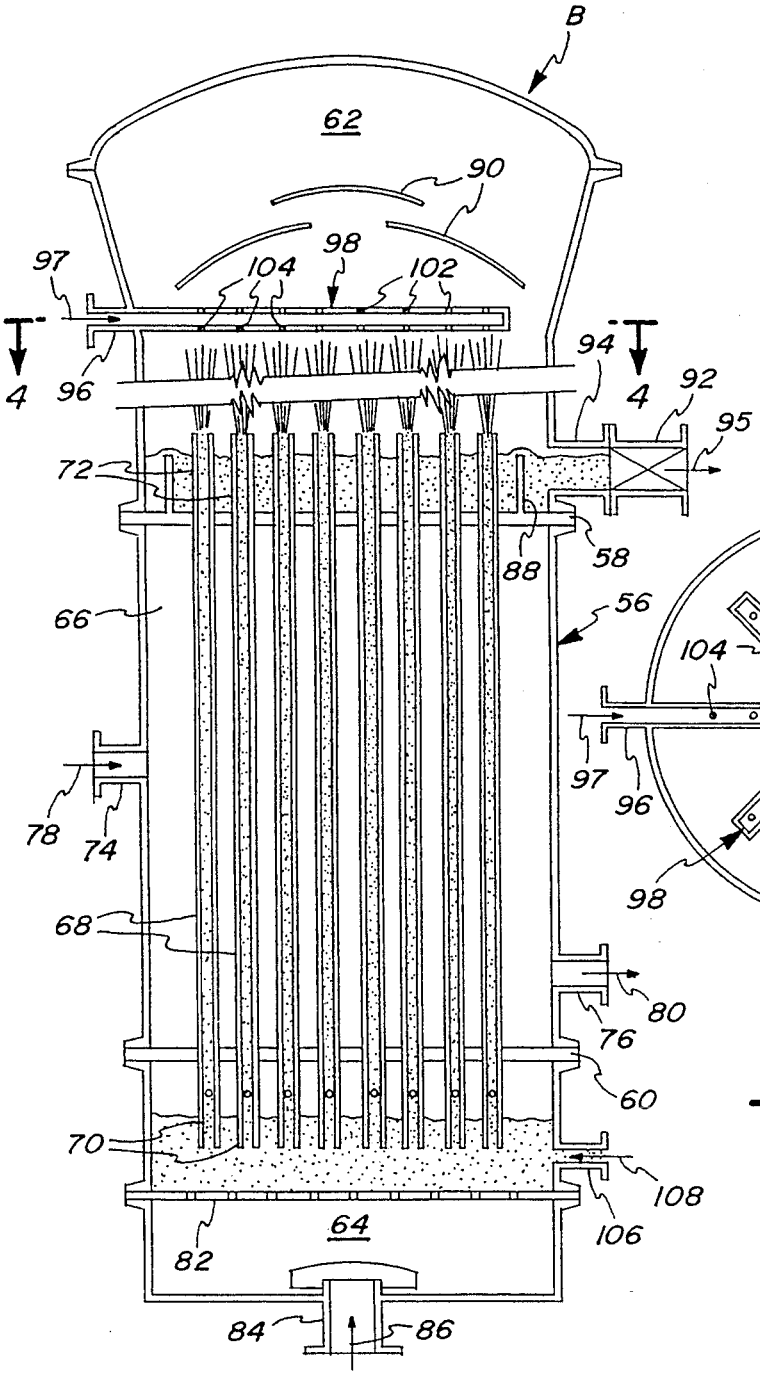
FIG. 3 illustrates another embodiment of the heat exchanger according to the present invention shown in vertical section with portions of the upper chamber broken away.

Turning now to FIG. 3, the heat exchanger or reactor B according to the present invention is shown in an alternative embodiment for use when thermocracking a hydrocarbon oil or other fluid at substantially higher temperatures where significant quantities of thermocracked vapors are generated. The heat exchanger B includes a shell or casing 56 divided by upper header plate 58 and lower header plate 60 into an upper chamber 62, lower chamber 64 and heat exchange chamber 66. A number of vertically extending riser tubes 68 are provided, each of which includes a tube inlet 70 and tube outlet 72 extending into the lower chamber 64 and upper chamber 62 respectively. A steam inlet connection 74 and steam outlet connection 76 are also provided. Arrow 78 indicates the direction of steam or some other heat exchange medium into heat exchange chamber 66 while arrow 80 indicates the direction of steam or other heat exchange medium leaving the heat exchange chambers 66.

A horizontal flow distribution plate 82 is provided with holes extending therethrough to retain the particulate media within the lower chamber 64 so that once the media is fluidized, it travels into the various tube inlets 70. A main inlet 84 is provided for entry of the hydrocarbon fluid to be thermocracked. Arrow 86 indicates direction of travel into the inlet 84. A retaining wall 88 extends upwardly from the upper header plate 58 so as to surround the riser tube outlets 72. A static mixer 92 is provided at outlet 94 to ensure thorough intermixing of the thermocracked vapors and liquids with the quench liquid prior to discharge in the direction indicated by arrow 95. Baffle plates 90 are disposed in the upper portion of chamber 62 to assist in deflection of vapors generated during the thermocracking.

Figure 4:
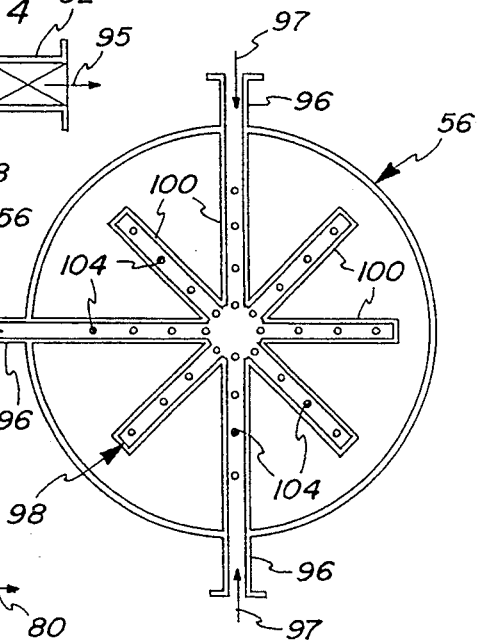
FIG. 4 is a horizontal section taken along lines 4—4 of FIG. 3.

As best shown in FIGS. 3 and 4, multiple quench inlets 96 are disposed about the perimeter of upper chamber 62 and extend therein. Arrows 97 indicate the direction of flow of the quench fluid into the inlets 97. A quench manifold 98 is horizontally disposed within upper chamber 62 to receive quench fluid from inlets 96 and to distribute the quench fluid within upper chamber 62. As best shown in FIG. 4, the manifold 98 comprises a number of individual manifold arms 100 radially extending from a common central point. Each of the various manifold arms 100 are provided with upper apertures or holes 102 and lower apertures or holes 104 to distribute quench fluid from the manifold in an upward direction against the baffle plates 90 and downward into the path of the cracked effluent leaving the riser tube outlet 72.

As can be appreciated, in the situation where the hydrocarbon oil is being visbroken at an extremely high temperature producing substantial quantities of cracked vapor, the quench manifold 98 will provide not only a quench fluid for the thermocracked liquid being generated but also for the thermocracked vapors accumulating in the upper region of chamber 62. In this way, carbon and coke which would otherwise accumulate within the interior of chamber 62 or downstream therefrom is effectively suppressed from forming. As with the embodiment shown in FIGS. 1 and 2, the temperature of the quench oil or liquid is closely controlled to allow it to effectively lower the temperature of the cracked effluent liquid in reactor B. The intermixed quench and thermocracked effluent may be removed from the reactor via outlet 94 to separate the cracked product, to add media or to remove carbon that has been abraded from the interior walls of the riser tubes. A recycle inlet 106 is shown entering the lower chamber 64 in the direction of arrow 108.

Figure 5:
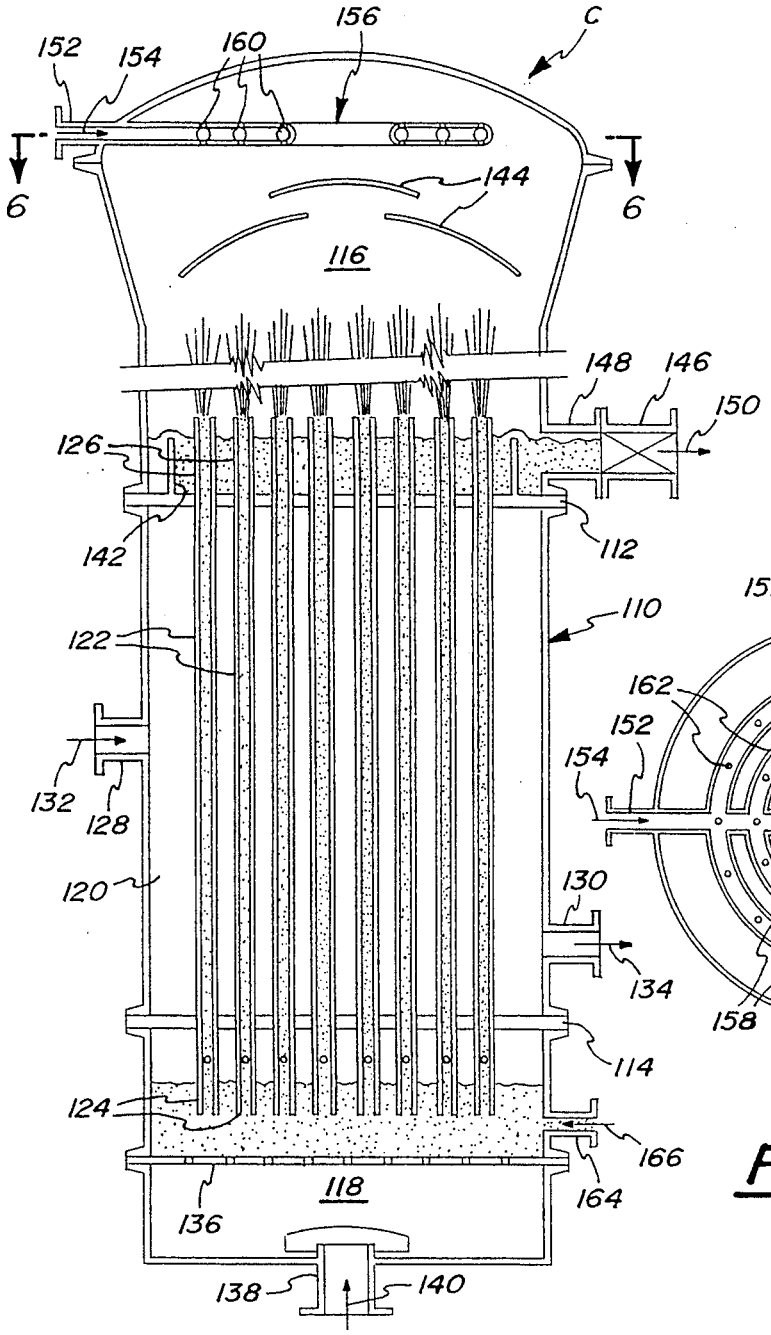
FIG. 5 illustrates another embodiment of the heat exchanger according to the present invention shown in vertical section with portions of the upper chamber broken away.

Turning now to FIG. 5, the heat exchanger or reactor C is shown in an alternative embodiment comprising a shell 110 divided by upper header plate 112 and lower header plate 114 into an upper chamber 116, a lower chamber 118 and a centrally disposed heat exchange chamber 120. A series of riser tubes 122 are vertically disposed as a bundle within the interior of heat exchange chamber 120, each of the tubes 122 includes a respective tube inlet 124 extending through lower header plate 114 into lower chamber 118 and a respective tube outlet 126 extending through upper header plate 112 into upper chamber 116. A steam inlet connection 128 and a steam outlet connection 130 are also provided for heat exchange chamber 120 with arrow 132 indicating direction of the steam or other heat exchange medium into the chamber and arrow 134 indicating the direction of the heat exchange medium from the reactor.

A horizontal flow distribution plate 136 having apertures therein is disposed in lower chamber 118 a selected distance beneath tube outlets 126 for retaining abrasive media therein prior to fluidization into the various riser tubes 122. A main inlet 138 is provided in lower chamber 118 for entry of the hydrocarbon oil or other fluid to be thermocracked or heat exchanged. Arrow 140 indicates direction of travel of the process fluid into the heat exchanger or reactor C. The upper chamber 116 is provided with a vertical retaining wall 142 extending perpendicular from upper header plate 112 and circumferentially around the riser tube outlets 126. A number of baffle plates 144 are disposed within the upper portion of upper chamber 116 to assist in deflecting the vapors generated during visbreaking. A static mixer 146 is provided at the main outlet 148 to ensure thorough intermixing of the quench liquid, thermocracked liquid and vapors immediately prior to discharge from the reactor C in the direction of arrow 150.

Figure 6:
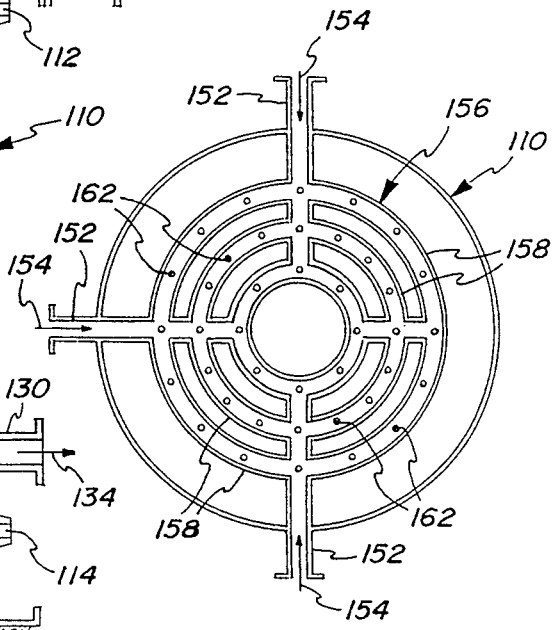
FIG. 6 is a horizontal section taken along lines 6—6 of FIG. 5.

As best shown in FIGS. 5 and 6, a number of quench inlets 152 are disposed about the perimeter of the upper chamber 116. A quench liquid such as heated crude oil enters the reactor in the direction of arrow 154. A quench manifold 156 is disposed within the interior of upper chamber 116 and above the baffle plate 144 to receive and distribute the quench within the interior of the upper chamber 116. The quench manifold 156 is shown as comprising a number of concentric manifold rings 158 each of which includes upper holes or apertures 160 and lower holes or apertures 162 through which the quench liquid passes into the chamber 116.

As can be appreciated, the embodiment shown in FIGS. 5 and 6 is designed for the situation where the hydrocarbon oil is thermocracked at an extremely high temperature and where a large volume of cracked vapors are generated within upper chamber 116. Thus, the quench manifold 156 is positioned such that the generated thermocracked vapors are immediately quenched by the quench oil it sprays into chamber 116. As noted earlier, the quench oil is preheated to a selected temperature to effectively remove heat from the thermocracked vapors and reduce the upper temperature below 700° F. thereby eliminating carbon deposition within the heat exchanger as well as downstream. A recycle inlet 164 is also provided to allow quenched and thermocracked effluent removed from outlet 148 to be recycled back into the lower chamber 118 for further thermocracking. As with the previous embodiments, the quenched and thermocracked effluent intermixed with particulate media may be treated to remove carbon particles abraded from the interior of the riser tubes 122 as well as to add process fluid or particulate media and to selectively adjust the fluidization rate into the heat exchanger C.

As can be appreciated, each of the various arrangements for distributing the quench shown in FIGS. 1–6 can be incorporated into a single heat exchanger or reactor in various combination depending upon the nature of the thermocracked fluid which is being generated within the upper chamber of the reactor.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A thermocracking reactor, said reactor adapted to confine all thermocracking of a fluid to within the interior of the reactor comprising:

a) a housing comprising a heat exchange chamber, an upper header chamber and a lower header chamber, said upper and lower header chambers being positioned at opposite ends of said heat exchange chamber and separated from fluid contact with said heat exchange chamber;

b) a plurality of upwardly extending riser tubes for conveying a fluid to be thermocracked, each of said tubes provided with an inlet and an outlet, said riser tubes extending through said heat exchange chamber for contacting with a heat exchange medium sufficient to thermocrack the fluid in said riser tubes, said riser tube inlets positioned within said lower header chamber and said riser tube outlets positioned within said upper header chamber;

c) fluid outlet means associated with said upper header chamber for discharging the fluid from said reactor;

d) quench means, including multiple fluid inlets positioned about the perimeter of said upper header chamber and forming openings thereinto, for simultaneously distributing a quench liquid throughout said upper header chamber sufficient to immediately quench any thermocracking vapor .and liquid leaving said riser tube outlets; and e) means, associated with said fluid outlet means, for thoroughly intermixing all fluid in said upper header chamber prior to discharge from said reactor.

2. A thermocracking reactor as in claim 1 and further comprising:

a) recycle means, associated with said fluid outlet means, for returning at least a portion of the discharged fluid to said lower header chamber for additional thermocracking.

3. A thermocracking reactor as in claim 1 and wherein:

a) said multiple fluid inlets are in a common horizontal plane with respect to each other.

4. A thermocracking reactor as in claim 1 and further comprising:

a) baffle means, positioned within said upper header chamber and above said riser tube outlets, for deflecting any thermocracking vapor and liquid leaving said riser tube outlets.

5. A thermocracking reactor as in claim 4 and wherein:

a) said baffle means positioned above said quench means.

6. A thermocracking reactor as in claim 4 and wherein:

a) said baffle means positioned below said quench means.

7. A thermocracking reactor as in claim 2 and further comprising:

a) granular material disposed inside the reactor and intermixed with the fluid being thermocracked and conveyable for abrading deposits from the interior of the riser tubes.

8. A reactor as set forth in claim 2 wherein:

a) said recycle means comprises a conduit for returning at least a portion of the discharged fluid from said upper header chamber to said lower header chamber.

9. A reactor as set forth in claim 1 and wherein:

a) said upper and lower header chambers separated from said heat exchange chamber by upper and lower header plates, respectively.

10. A reactor as set forth in claim 9 and further comprising:

a) circumferential barrier means surrounding said riser tube outlets to temporarily retain fluid within the upper header chamber prior to discharge therefrom.

11. A thermocracking reactor as in claim 10 and wherein:

a) said barrier means comprises a continuous wall extending upwardly from said upper header plate a distance below said riser tube outlets.

12. A reactor as set forth in claim 1 and wherein:

a) said quench means comprises a distribution manifold positioned above said riser tube outlets to distribute the quench liquid throughout said upper header chamber, said multiple fluid inlets are integral with said manifold.

13. A reactor as set forth in claim 12 and wherein:

a) said distribution manifold includes apertures for spraying the quench liquid from said manifold to said upper header chamber.

14. A reactor as set forth in claim 12 and wherein:

a) said distribution manifold comprises a series of concentric rings in a common horizontal plane.

15. A reactor as set forth in claim 12 and wherein:

a) said distribution manifold is asterisk shaped.

16. A reactor as set forth in claim 2 and wherein:

a) said recycle means including a pump means for reintroducing at least a portion of the quenched, thermocracked fluid into said lower header chamber.

17. A reactor as set forth in claim 7 and wherein:

a) said recycle means including a cyclone separator means for separation of the granular material from the fluid.

18. A reactor as set forth in claim 13 and wherein:

a) said distribution manifold has top and bottom surfaces;

b) said apertures extending through said distribution manifold top and bottom surfaces to allow the quench liquid to be distributed both above and below said distribution manifold.

19. A reactor as set forth in claim 8 and wherein:

a) said conduit means extends exterior of said housing and is in fluid communication therewith.

* * * * *